US009452808B1

(12) United States Patent
Oklejas, Jr.

(10) Patent No.: US 9,452,808 B1
(45) Date of Patent: Sep. 27, 2016

(54) HIGH SPEED WATERCRAFT STABILIZATION

(71) Applicant: Eli Oklejas, Jr., Newport, MI (US)

(72) Inventor: Eli Oklejas, Jr., Newport, MI (US)

( * ) Notice: Subject to any disclaimer, the term of this patent is extended or adjusted under 35 U.S.C. 154(b) by 29 days.

(21) Appl. No.: 14/160,600

(22) Filed: Jan. 22, 2014

Related U.S. Application Data

(60) Provisional application No. 61/755,127, filed on Jan. 22, 2013.

(51) Int. Cl.
*B63B 1/00* (2006.01)
*B63B 1/32* (2006.01)

(52) U.S. Cl.
CPC ..... *B63B 1/32* (2013.01)

(58) Field of Classification Search
CPC ..... B63B 1/22; B63B 35/34; B63B 1/14; B63B 1/32
USPC ..... 114/283, 292, 61.18, 61.5
See application file for complete search history.

(56) References Cited

U.S. PATENT DOCUMENTS

| | | | | |
|---|---|---|---|---|
| 3,763,809 | A * | 10/1973 | Pazos | 114/265 |
| 4,730,570 | A * | 3/1988 | Harris | 114/61.18 |
| 5,107,783 | A * | 4/1992 | Magazzu | B63B 1/14 114/123 |
| 5,390,623 | A * | 2/1995 | Mackaness | 114/282 |
| 6,095,076 | A * | 8/2000 | Nesbitt | 114/279 |
| 2010/0000454 | A1 * | 1/2010 | Grenestedt | 114/61.15 |

* cited by examiner

*Primary Examiner* — Stephen Avila
(74) *Attorney, Agent, or Firm* — Harness, Dickey & Pierce, P.L.C.

(57) ABSTRACT

A watercraft includes a hull, a first sponson and a first movement damper coupled to the first sponson that dampens movement of the first sponson relative to the hull. The watercraft further includes a second sponson and a second movement damper coupled to the second sponson damping movement of the second sponson relative to the hull.

17 Claims, 4 Drawing Sheets

HIGH SPEED WATERCRAFT STABILIZATION

CROSS-REFERENCE TO RELATED APPLICATIONS

This application claims the benefit of U.S. Provisional Application No. 61/755,127 filed on Jan. 22, 2013. The disclosure of the above application is incorporated herein by reference.

TECHNICAL FIELD

The present disclosure relates generally to high speed watercraft, and, more specifically, to an apparatus to control movement of a sponson to control stability of the watercraft.

BACKGROUND

The statements in this section merely provide background information related to the present disclosure and may not constitute prior art.

High-speed watercraft rely on hydrodynamic forces to elevate the hull above its at rest position. The at rest position is known as the displacement depth. When the hull is elevated above its normal position, the watercraft is said to be planing. While planing, the watercraft is subjected to severe forces resulting from the impact of the watercraft with waves. The body or hull may subject the hull to potential damage. Also, the forces may create vibrations and also cause the propeller or rutter to lose optimal immersion in the water. Because of these forces, a reduction in speed may be required to change direction of travel. Slowing during a race in high speed watercraft is not desirable. Hydroplanes are one example of an extreme use of planing to minimize hull drag.

Referring now to FIG. 1, major features of a watercraft 10, such as a hydroplane, are illustrated. The watercraft 10 includes an engine 12 mounted to a hull 14. The engine 12 drives a propeller 16. The hull 14 includes a cockpit 18. Sponsons 20, 21 are rigidly attached to the fore portion of the hull 14. The driver sits in the cockpit 18 and controls the speed of the engine and a rudder (not shown). An adjustable wing or canard 24 is mounted between the sponsons 20, 21 and is also controlled by the driver within the cockpit 18. The canard 24 may be adjusted to produce a desired aerodynamic force to maintain stability. A foot pedal within the cockpit 18 is typically used to adjust the canard 24. An air intake 28 is used for providing air into the engine 12.

Referring now to FIG. 2, by adjusting the canard 24, the air trap 30 between the bottom of the hull and the surface of the water is increased or decreased which, in turn, increases or decreases the clearance 32.

Referring now to FIG. 3, at speed, the watercraft 10 typically touches the water in three locations. Each sponson 20, 21 touch the water at a contact area 40. The third location is the propeller 16. A desired contact position for the propeller 16 is about halfway across the propeller 16. The pressure increase within the air trap causes hydrodynamic lift that causes the hull 14 to establish the running clearance 32. The canard 24, illustrated in FIGS. 1 and 2, is adjusted to keep the clearance 32 at a desired value to counteract the impact of the waves on the sponsons 20, 21. Wind gusts, however, may affect the pressure within the air trap 30.

The propeller 16 provides a horizontal thrust force to propel the craft forward and also provides a vertical thrust force to lift the aft portion of the hull clear of the water. Propeller efficiency is reduced when a deviation from ideal immersion is present.

Referring now to FIG. 4, the watercraft 10 is illustrated in an elevated position that shows the motion of air 50 that results in placing the craft in an out-of-control condition during a flip or roll. At high speeds, relatively small waves may result in a strong vertical force acting on the sponsons that allow the motion of air 50 to lift the watercraft and move the watercraft in an up and outward direction.

SUMMARY

This section provides a general summary of the disclosure, and is not a comprehensive disclosure of its full scope or all of its features.

The present disclosure provides an improved apparatus for controlling stability of a watercraft by controlling movement the movement of the sponsons.

In one aspect of the disclosure, a watercraft includes a hull, a first sponson and a first movement damper coupled to the first sponson damping movement of the first sponson relative to the hull. The watercraft further includes a second sponson and a second movement damper coupled to the second sponson damping movement of the second sponson relative to the hull.

In another aspect of the disclosure, a watercraft includes a hull, a first sponson, a first strut pivotally coupled between the hull and the first sponson and a first spring coupled between the first strut and the hull. The watercraft also includes a second sponson, a second strut pivotally coupled between the hull and the second sponson and a second spring coupled between the second strut and the hull.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
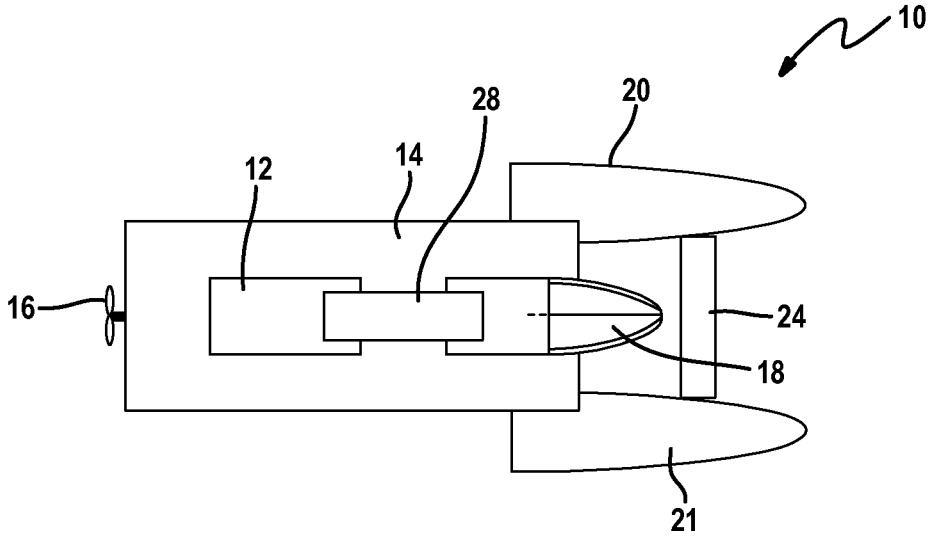
FIG. 1 is a top view of a watercraft according to the prior art.
Figure 2:
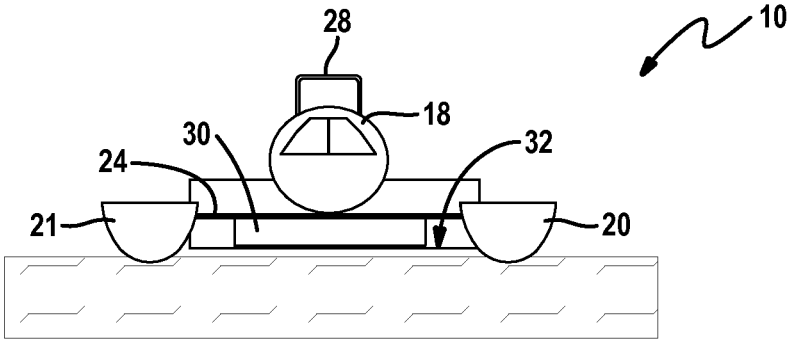
FIG. 2 is a front view of the prior art watercraft.
Figure 3:
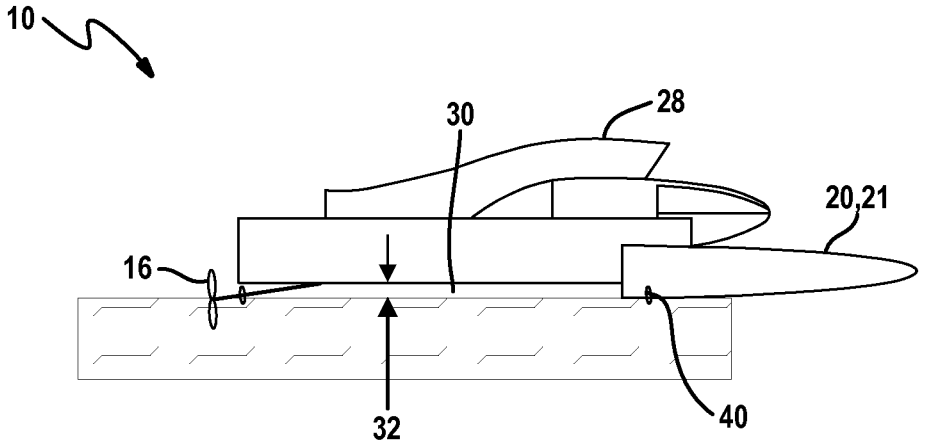
FIG. 3 is a side view of the watercraft of the prior art.
Figure 4:
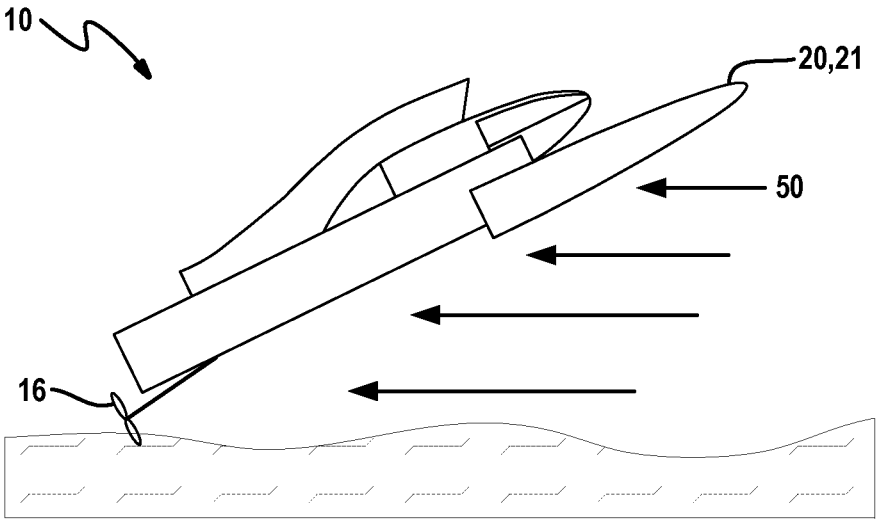
FIG. 4 is a side view of an elevated position of the watercraft relative to the water.

The following description is merely exemplary in nature and is not intended to limit the present disclosure, application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

It would be desirable to more precisely control the position of the watercraft relative to the water.

Figure 5:
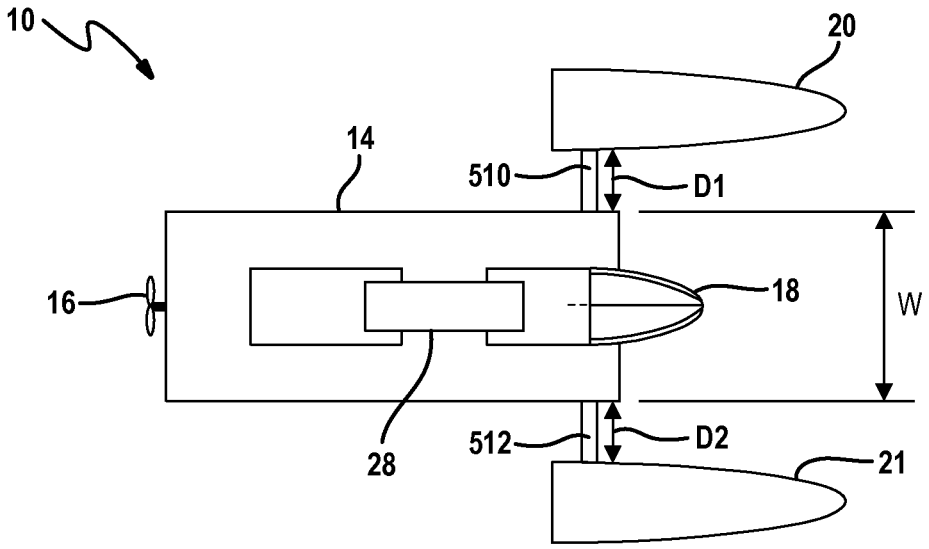
FIG. 5 is a top view of a watercraft with movable sponsons according to the present disclosure.

In the following description, the watercraft 10 having movable sponsons 20, 21 is described. Although technically sponsons may not be movable as illustrated in FIGS. 1-4, the sponson or float is continued to be referred to as a sponson 20, 21. Referring now to FIG. 5, the basic elements set forth above are labeled in the same way. In this example, however, the sponsons 20, 21 are movably coupled or physically connected to the hull 14 with a respective strut 510, 512. The struts 510, 512 space the sponsons 20, 21 from the hull a distance D1, D2, respectively. As will be mentioned below, the distances D1, D2 may vary depending upon the speed of the watercraft 10. The distance D1, D2 may not be the same due to turning and the like. The sponsons 20, 21 are located forward of the center of gravity of the hull 14. The sponsons 20, 21 may be spaced apart various amounts relative to each other and relative to the hull. In one example, the space between the sponsons 20, 21 was twice the width W of the hull 14.

Figure 6:
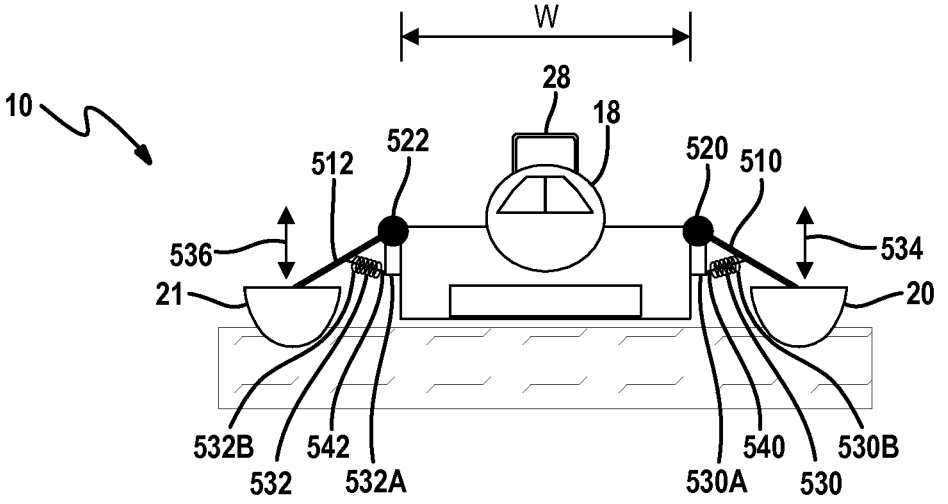
FIG. 6 is a front view of the watercraft according to the present disclosure.

Referring now to FIG. 6, details of the mounting of the struts 510, 512 are illustrated in further detail. In this example, the struts 510, 512 are pivotally mounted to respective pivot points 520, 522.

In addition to the struts 510, 512, springs 530, 532 may be coupled between the hull 14 and the respective struts 510, 512. Spring 530 has a first end 530A coupled to the hull 14 and a second end 530B coupled to the strut 510. Spring 532 has a first end 532A coupled to the hull 14 and a second end 532B coupled to the strut 512.

The springs 530, 532 are in compression to force the respective sponsons 20, 21 into the water to lift the hull 14. The reaction forces generated by the sponsons 20, 21 that lift the hull 14 are due to displacement buoyancy at low speed and increased hydrodynamic lift as the speed increases. This provides the planing effect. The sponsons 20, 21 move in a vertical direction illustrated by arrows 534, 536. The movement of the arrows 534, 536 is relative to the hull 14. Thus, during operation, the position of the sponsons 20, 21 changes relative to the hull 14 unlike the configurations illustrated in FIGS. 1-4. The springs 530, 532 transfer lift generated by the sponsons 20, 21 to raise the hull 14 above the water surface at speeds. The springs 530, 532 also dampen relative movement of the sponsons with the hull. Shock absorbers 540, 542 may also be disposed coaxially with each respective spring 530, 532. The shock absorbers 540, 542 dampen movement of the respective sponsons 20, 21.

Although only one strut 510, 512 on each side is illustrated, multiple struts may be required to handle the stress of the movement of the sponsons 20, 21 relative to the hull 14. In this configuration, the sponsons 20, 21 are free to pitch up and down in response to wave impact to lessen torque transfer through the struts 510, 512. The distance between the hull 14 and each sponson 20, 21 may vary independently.

In operation, the sponsons 20, 21 are configured so that forward motion produces lift to achieve planing at sufficient speed. As the watercraft accelerates, the sponsons 20, 21 rise and lift the front portion of the hull out of the water while the propeller produces a vertical force to lift the rear portion of the hull 14 out of the water. As the speed increases, sponsons 20, 21 achieve a full planing action with contact only on a relatively small bottom portion of each sponson 20, 21.

In smooth water, the sponsons 20, 21 move smoothly over the water with little relative motion between the sponson and the hull. When a disturbance in the water, such as a wave or debris impacts one of the sponsons 20, 21, the sponson 20, 21 may be driven vertically upward in the direction of arrows 534, 536 to reduce the impact. The pivot points 520, 522 allow the struts 510, 512 to prevent the force of impact from being transmitted to the hull 14. The springs 530, 532 provide a force to restore the sponson 20, 21 to its normal position after the disturbance is past. The shock absorbers 540, 521 also minimize the tendency for a resonance to be created.

Figure 7:
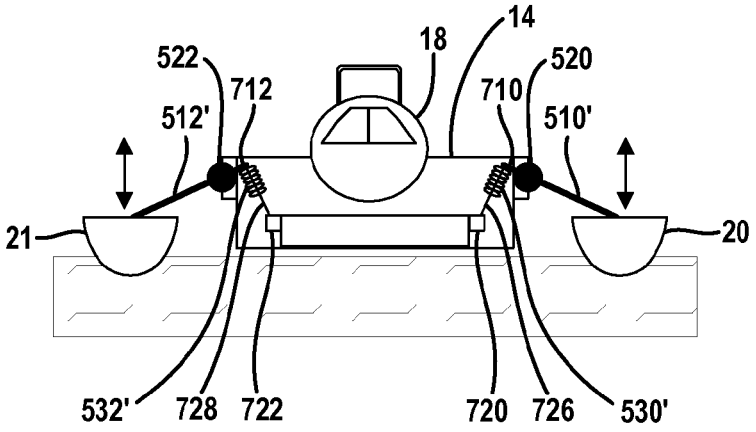
FIG. 7 is a front view of the watercraft according to a second example.

Referring now to FIG. 7, another example for the struts 510', 512' is illustrated. In this example, the pivot points 520, 522 are not located at the end of the struts, as in FIGS. 5 and 6, but rather provide the fulcrum for the struts 510', 512' that pass therethrough. Thus, each respective strut 510', 512' include a respective end 710, 712 that extend into and within the hull 14. Springs 530', 532' are coupled to or near the respective ends 710, 712 and to the interior of the hull 14. A respective mount 720, 722 within the hull 14 secures the respective ends of the springs 530', 532'. A shock absorber 726, 728 may also be coaxially located with the springs 530', 532'. By placing the springs 530', 532' and shock absorbers 726, 728 within the hull 14, the exposure to high velocity water and air may be reduced. In this example, the springs 530', 532' may be under compression.

By moving the springs 530', 532' into the hull 14, different springs and damper rates may be used based upon the various conditions. By allowing technicians to easily replace the springs and dampers inside the hull 14, adjustments for different wave heights may be easily accomplished. The shock absorber damping rates may also be adjusted by changing a needle valve to change the resistance of flow fluid within the damper chambers.

Figure 8:
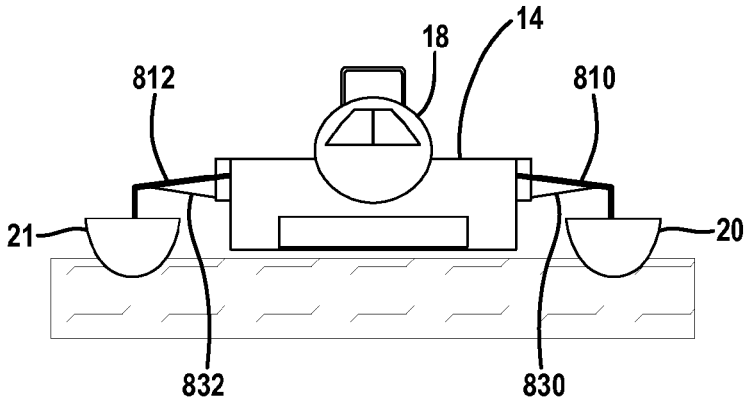
FIG. 8 is a front view of a third embodiment of a strut according to the present disclosure.
Figure 9:
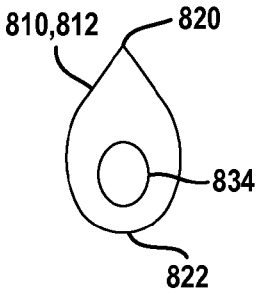
FIG. 9 is a cross-sectional detail of one example of the strut of FIG. 8.

Referring now to FIGS. 8 and 9, another example of the struts 810, 812 is illustrated. In this example, the struts 810, 812 may have a forward portion 820 and a rearward portion 822 to reduce the amount of drag by the struts. In this example, the struts 810, 812 may act as a stiff spring themselves. The struts 810, 812 have a predetermined stiffness to allow the strut 810, 812 to act as the spring in the previous examples. A damper 830 disposed outside the strut 810, 812 may be used to suppress resonance. The damper 830 is illustrated outside of the struts 810, 812. A damper 834 may also be disposed within each strut 810, 812. This may be in addition to or in place of the damper 830. The tear drop shape of the struts 810, 812 minimizes drag as is best illustrated in the cross-section FIG. 9.

By reducing the effects of the waves on the sponsons 20, 21, the hull 14 is less susceptible to vibrations, pitching and yawing. The propeller remains properly immersed in water for maximum performance despite surface waves causing relative movement of the sponsons.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A watercraft comprising a hull;

a first sponson positioned a first distance away from and to the side of and not under the hull and positioned forward of a center of gravity of the hull, said first sponson produces lift at sufficient speed to lift the hull;

a first strut having a first end pivotally mounted to the hull and a second end mounted to the first sponson;

a first movement damper comprising a first shock absorber and first spring coaxially mounted to the hull and mounted to the first strut between the first and second ends of the first strut, the first movement damper damping movement of the first sponson relative to the hull;

a second sponson positioned a second distance away from and to the side of and not under the hull and positioned forward of the center of gravity of the hull, the second sponson produces lift at sufficient speed to lift the hull; and a second strut having a third end pivotally mounted to the hull and a fourth end mounted to the second sponson;

a second movement damper comprising a second shock absorber and a first spring coaxially mounted to the hull and mounted to the second strut between the third and fourth ends of the second strut, the second movement damper damping movement of the second sponson relative to the hull.

2. The watercraft as recited in claim 1 wherein the first strut and the second strut have a predetermined stiffness.

3. The watercraft as recited in claim 1 wherein a first end of the first spring is coupled outside of the hull and a second end of the second spring is coupled outside the hull.

4. The watercraft as recited in claim 1 wherein the first strut comprises a tear drop-shaped cross-section.

5. A watercraft comprising a hull;

a first sponson positioned at a first distance away from and to the side of and not under the hull;

a first strut having a first end pivotally mounted to the hull and a second end mounted to the first sponson;

a first spring mounted to the hull and mounted to the first strut between the first and second ends of the first strut;

a second sponson positioned at a second distance away from and to the side of and not under the hull and positioned forward of the center of gravity of the hull and a fourth end mounted to the second sponson; and a second strut having a third end pivotally mounted to the hull and a fourth end mounted to the second sponson; and a second spring mounted to the hull and mounted to the second strut between the third and fourth ends of the second strut.

6. The watercraft as recited in claim 5 further comprising a first shock absorber coupled between the first strut and the hull and a second shock absorber coupled between the second strut and the hull.

7. The watercraft as recited in claim 5 wherein a first end of the first spring is coupled outside of the hull and a second end of the second spring is coupled outside of the hull.

8. The watercraft as recited in claim 7 further comprising a first shock absorber coupled between the first strut and the hull, and a second shock absorber coupled between the second strut and the hull.

9. The watercraft as recited in claim 8 wherein the first shock absorber is coaxial with the first spring and the second shock absorber is coaxial with the second spring.

10. The watercraft as recited in claim 5 wherein the first strut comprises a tear drop-shaped cross section.

11. The watercraft as recited in claim 1, wherein the second distance is not equal to the first distance.

12. The watercraft as recited in claim 5, wherein the second distance is not equal to the first distance.

13. The watercraft as recited in claim 6, wherein the first shock absorber is coaxial with the first spring and the second shock absorber is coaxial with the second spring.

14. A watercraft comprising:

a hull;

a first sponson positioned at a first distance away from and to the side of and not under the hull and positioned forward of a center of gravity of the hull, said first sponson produces lift at sufficient speed to lift the hull;

a first strut having a first end mounted to the hull and a second end mounted to the first sponson;

a first damper disposed within the first strut;

a second sponson positioned at a second distance away from and to the side of and not under the hull and positioned forward of the center of gravity of the hull; said second sponson produces lift at sufficient speed to lift the hull;

a second strut having a third end mounted to the hull and a fourth end mounted to the second sponson; and a second damper disposed within the second strut.

15. The watercraft as recited in claim 14, wherein the first and second struts comprise tear drop-shaped cross sections.

16. The watercraft as recited in claim 14, further comprising a third damper and a fourth damper, the third damper being coupled between the hull and the first strut, the fourth damper being coupled between the hull and the second strut.

17. The watercraft as recited in claim 14, wherein the second distance is not equal to the first distance.

* * * * *